US006332586B1

(12) United States Patent
Risa et al.

(10) Patent No.: US 6,332,586 B1
(45) Date of Patent: Dec. 25, 2001

(54) WINDING DEVICE, PARTICULARLY FOR WINDING UP FIRE HOSES

(75) Inventors: Bjørn Gunnar Risa; Tor Einar Risa, both of Nærbø (NO)

(73) Assignee: Ripro AS, Naerbo (NO)

( * ) Notice: Subject to any disclaimer, the term of this patent is extended or adjusted under 35 U.S.C. 154(b) by 0 days.

(21) Appl. No.: 09/582,103

(22) PCT Filed: Dec. 15, 1998

(86) PCT No.: PCT/NO98/00381

§ 371 Date: Jul. 20, 2000

§ 102(e) Date: Jul. 20, 2000

(87) PCT Pub. No.: WO99/33739

PCT Pub. Date: Jul. 8, 1999

(30) Foreign Application Priority Data

Dec. 29, 1997 (NO) ..... 19976088

(51) Int. Cl.[7] ..... B56H 18/08

(52) U.S. Cl. ..... 242/530.2; 242/532.6

(58) Field of Search ..... 242/532.5, 532.6, 242/532.7, 530.2, 423.1, 396.9, 395, 586.5; 254/213

(56) References Cited

U.S. PATENT DOCUMENTS

| | | | |
|---|---|---|---|
| 2,189,547 | | 2/1940 | Fischer . |
| 3,168,260 | * | 2/1965 | Kittelson . |
| 3,954,226 | | 5/1976 | Pickering . |
| 4,007,887 | | 2/1977 | Vice . |
| 4,022,398 | | 5/1977 | Youngblood . |
| 4,251,038 | | 2/1981 | Gename . |
| 4,266,740 | * | 5/1981 | Ramos et al. . |
| 4,390,141 | * | 6/1983 | Webster . |
| 4,770,361 | * | 9/1988 | Maeda . |
| 5,102,061 | * | 4/1992 | Suzuki et al. . |
| 5,961,061 | * | 10/1999 | Stanley . |
| 6,068,210 | * | 5/2000 | Risa et al. ..... 242/532.5 |

FOREIGN PATENT DOCUMENTS

| | | |
|---|---|---|
| 673012 | 2/1939 | (DE) . |
| 2637016 | 3/1977 | (DE) . |
| 2618308 | 11/1977 | (DE) . |
| 3704957 | 8/1988 | (DE) . |
| 301635 | 11/1997 | (NO) . |

* cited by examiner

*Primary Examiner*—William A. Rivera
(74) *Attorney, Agent, or Firm*—Stevens, Davis, Miller & Mosher, L.L.P.

(57) ABSTRACT

A winding device for fire hoses (40, 42), loading straps, etc., comprises a freely rotatably mounted, sleeve-shaped coil (12) having a longitudinal cavity (36) which, circumferentially, is defined between two clamp faces (14*a*, 14*b*). Within the cavity (36) is disposed a clamp means (34) firmly connected to a crank device (26', 26, 24, 32) and pivotal from a first position, resting against a first clamp face (14*a*), to a second position, resting against a second clamp face (14*b*). The clamp means (34) is a straight, rod-shaped element connected to the crank shaft (24) through a lateral crank arm (32) outside the inner cavity (12') of the coil (12). A starting portion of a fire hose, e.g. a loop-shaped portion (42) at the center of a double-laid fire hose (40), can be placed around such a clamp means (34), whereupon the hose is wound up.

3 Claims, 6 Drawing Sheets

WINDING DEVICE, PARTICULARLY FOR WINDING UP FIRE HOSES

BACKGROUND OF THE INVENTION

This invention relates to a winding device for winding tape-like or flattened hose-like elements, especially fire hoses and socalled loading straps, comprising a rotary coil and an operating means, e.g. a manually operated crank, and including a preferably crank-activated fixing means for firmly attachment of the fire hose portion where the winding starts, to the rotary coil.

Preferably, the device should be such that a fire hose having a connector at each end, in completely wound condition, should be able to be pulled off from the winding device and afterwards maintain its orderly wound condition. Thus, one winding device may be used for controlled winding of a substantial number of fire hoses, making them clear in spiral-wound condition.

The withdrawal direction may suitably coincide with the crank axis.

Fire hoses may be wound up in one of two different ways, requiring only one embodiment of the winding device according to the invention, certainly somewhat modified from case to case: In the first case, the fire hose is disposed double, causing half winding length and a loop at the centre of the normal length thereof, the two end connectors being positioned at the other end of the winding length. In the other case, the fire hose is completely extended in its longitudinal direction, having one end connector at each end. As the end portion of the fire hose in both cases has to be accommodated within the sleeve-shaped, rotary coil of the winding device and the end connectors of fire hoses have a rather substantial size, a coil having a significantly larger internal diameter is used when the fire hose has to be wound up from completely extended condition than when the winding starts at said loop forming the centre for a fire hose placed double.

Norwegian patent No. 301,635 discloses a winding device of the kind defined introductorily. According to this Norwegian patent specification, one has primarily aimed at winding up loading straps. However, it is mentioned that the winding device likewise could be usable for winding up e.g. fire hoses, without going further into the special winding methods for fire hoses.

For winding a loading strap, the coil is formed with an axially directed cavity radially defined by two radial clamp faces of the coil sleeve at the cavity. The crank shaft extends through the bore of the coil sleeve and has in the area of the through-going cavity of the coil a clamp portion parallel to the crank shaft, projecting laterally out from the latter. In the circumferential direction of the coil sleeve, this clamp portion has a substantially smaller thickness than the width of the coil sleeve cavity.

With the crank occupying one or the other starting position, the clamp portion of the crank shaft, thus, can be adjusted such that it is positioned in the proximity of one clamp face and further spaced from the other clamp face defining the coil sleeve cavity. Thus, it becomes easy to position the loading strap end in between the clamp portion of the crank shaft and the clamp face positioned furthest away, defining the coil sleeve cavity. As soon as the loading strap end has been brought into place, one starts the winding, whereby the crank shaft brings with it the clamp portion thereof, placing the loading strap in between that portion and the clamp face of the coil. Now, the coil is turned during the winding of the loading strap upon the rotation of the crank.

The fixing force obtainable with this known winding device which, especially, has been developed for winding up loading straps, has been found to be insufficient upon the clamping and subsequent winding of fire hoses, the device being insignificantly fit for the attachment of a loop-shaped end portion of a fire hose to be wound and, thereupon, withdrawn from the device.

SUMMARY OF THE INVENTION

It has been an object of the present invention to provide a winding up device which is particularly well suited in connection with the winding of fire hoses, and having an easily releasable fixing means for fixing a loop-shaped portion of the fire hose.

According to the invention, this object is realized by means of a winding device, the distinctive features thereof appearing from the characterizing clause of claim 1.

The clamp means of the winding device connected to the crank shaft, has a rectilinear, freely ending course parallel with the axis of the crank, and, in the radial direction, the clamp means may be positioned at least approximately at the same distance from the coil's axis as the radially extending faces defining the cavity of the coil and of which one constitutes a clamp face cooperating with the clamp means, in order to fix one end portion of the fire hose, said clamp means constituting a projection connected to the crank shaft only at or in the proximity of the axially innermost end of the coil. Such a shaped and designed clamp means having a long, free portion is well suited for accommodating and fixing a loop-shaped end of a double-laid fire hose.

In the following, the invention is further explained in association with preferred embodiments representing examples of the design and use of the invention, with reference being made to the accompanying drawings.

DETAILED DESCRIPTION OF THE PREFERRED EMBODIMENTS

Figure 1:
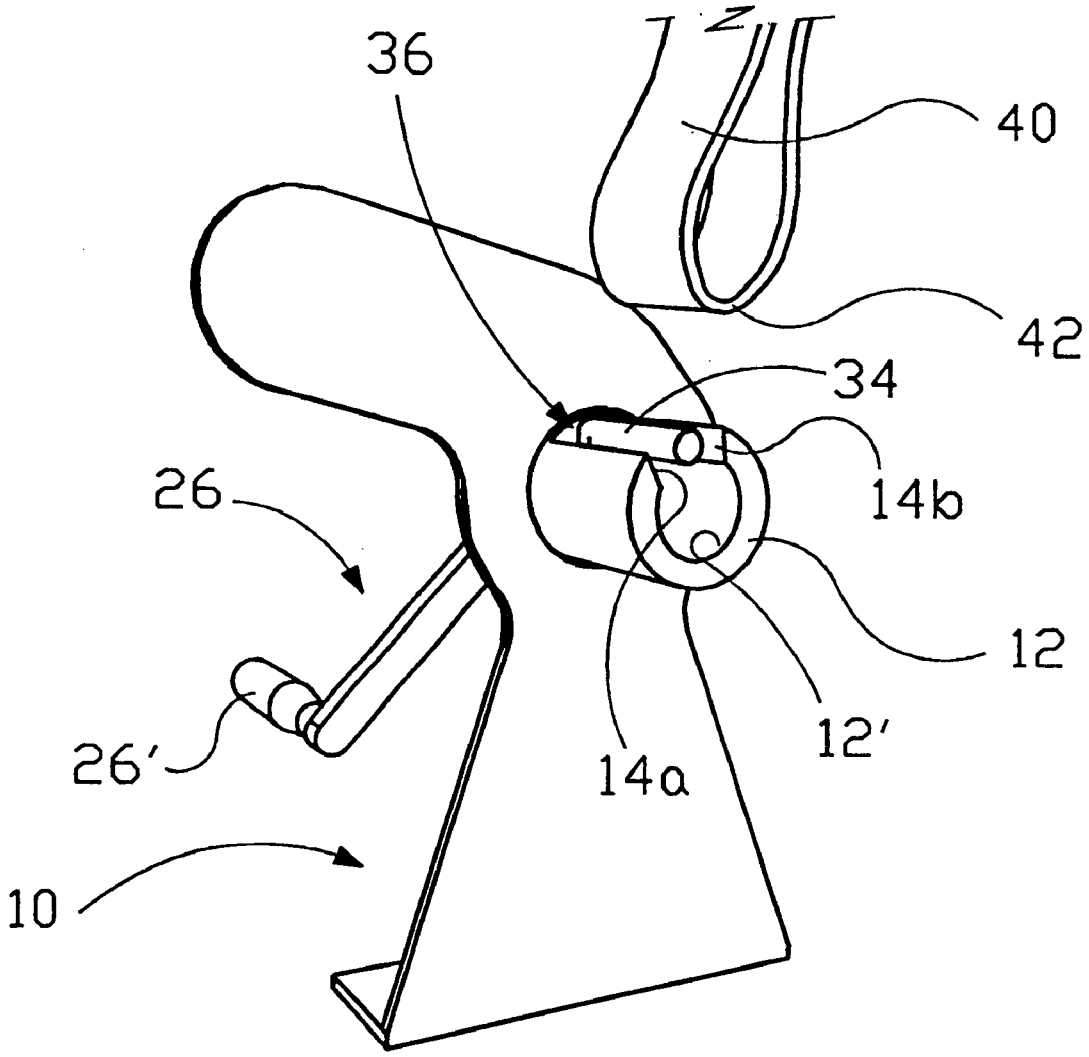
FIG. 1 shows the winding device in perspective view, said loop-shaped end being made clear to be fixed on the clamp means connected eccentrically to the crank.
Figure 2:
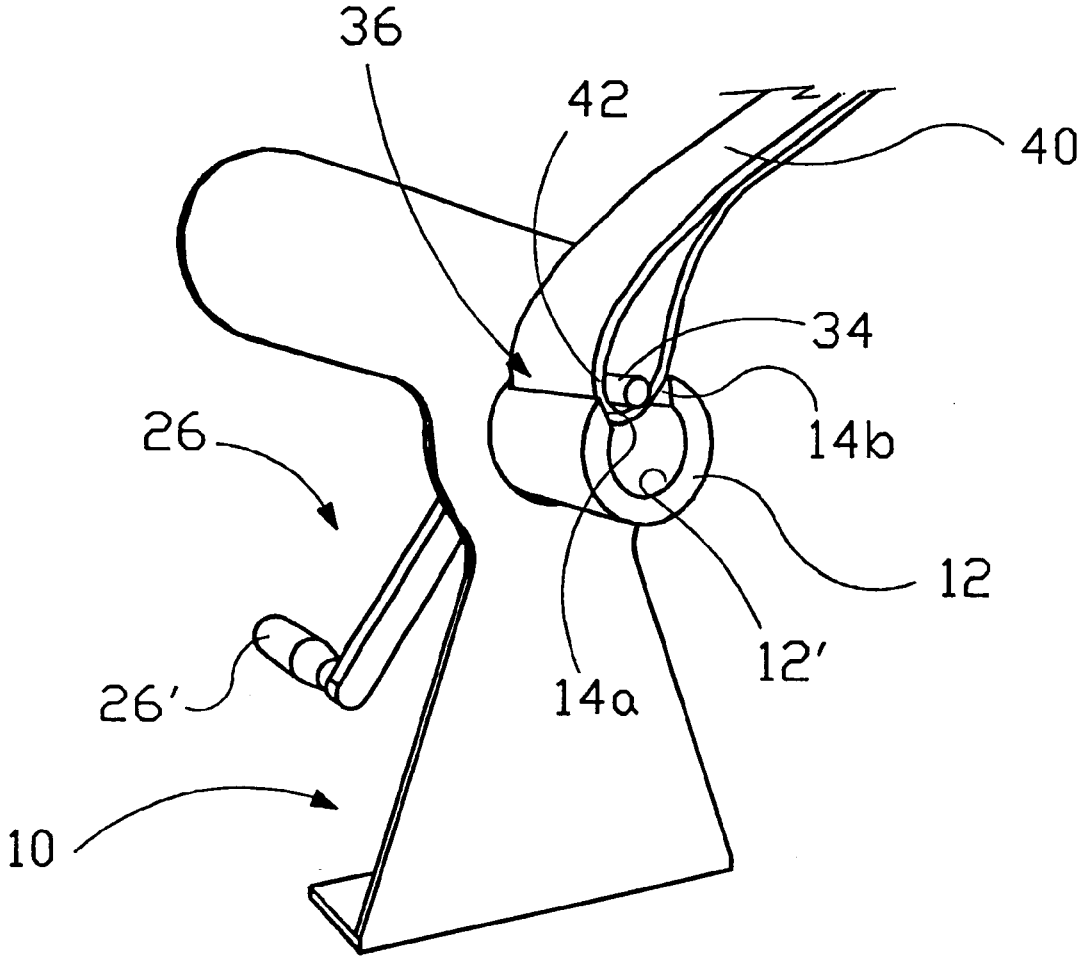
FIG. 2 corresponds to FIG. 1, but here said loop-shaped end has been brought into engagement with the projecting clamp means, immediately before the winding is started.
Figure 3:
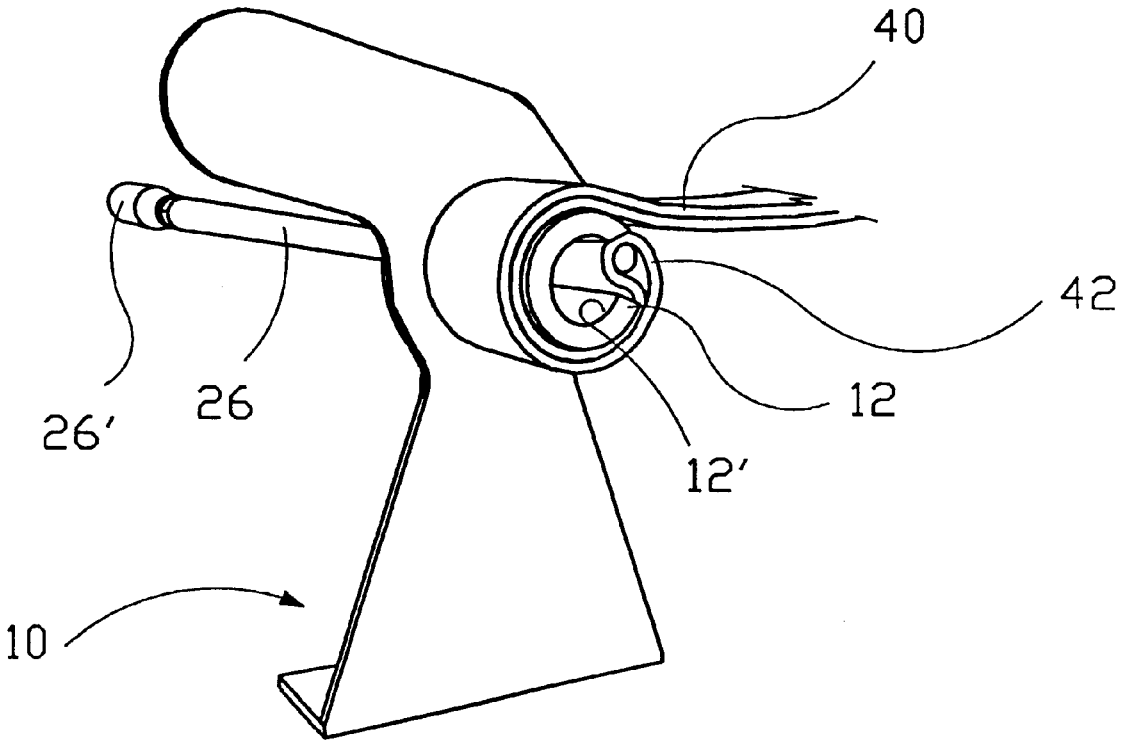
FIG. 3 corresponds to FIG. 2, but here the coil has been rotated almost one revolution anti-clockwise.

In the embodiment shown in the drawings, the winding device according to the invention has a support frame 10 consisting of a plate cut and bent into shape and having a lower right-angledly bent off base plate fastenable to a stable foundation. This support frame 10, its rotatably mounted, sleeve-shaped, projecting coil 12 having a longitudinal cavity through the sleeve-shaped coil wall, circumferentially defined between two opposing clamp faces 14*a*, 14*b* are features substantially known from Norwegian patent specification No. 301,635, likewise crank-operated.

Figure 7:
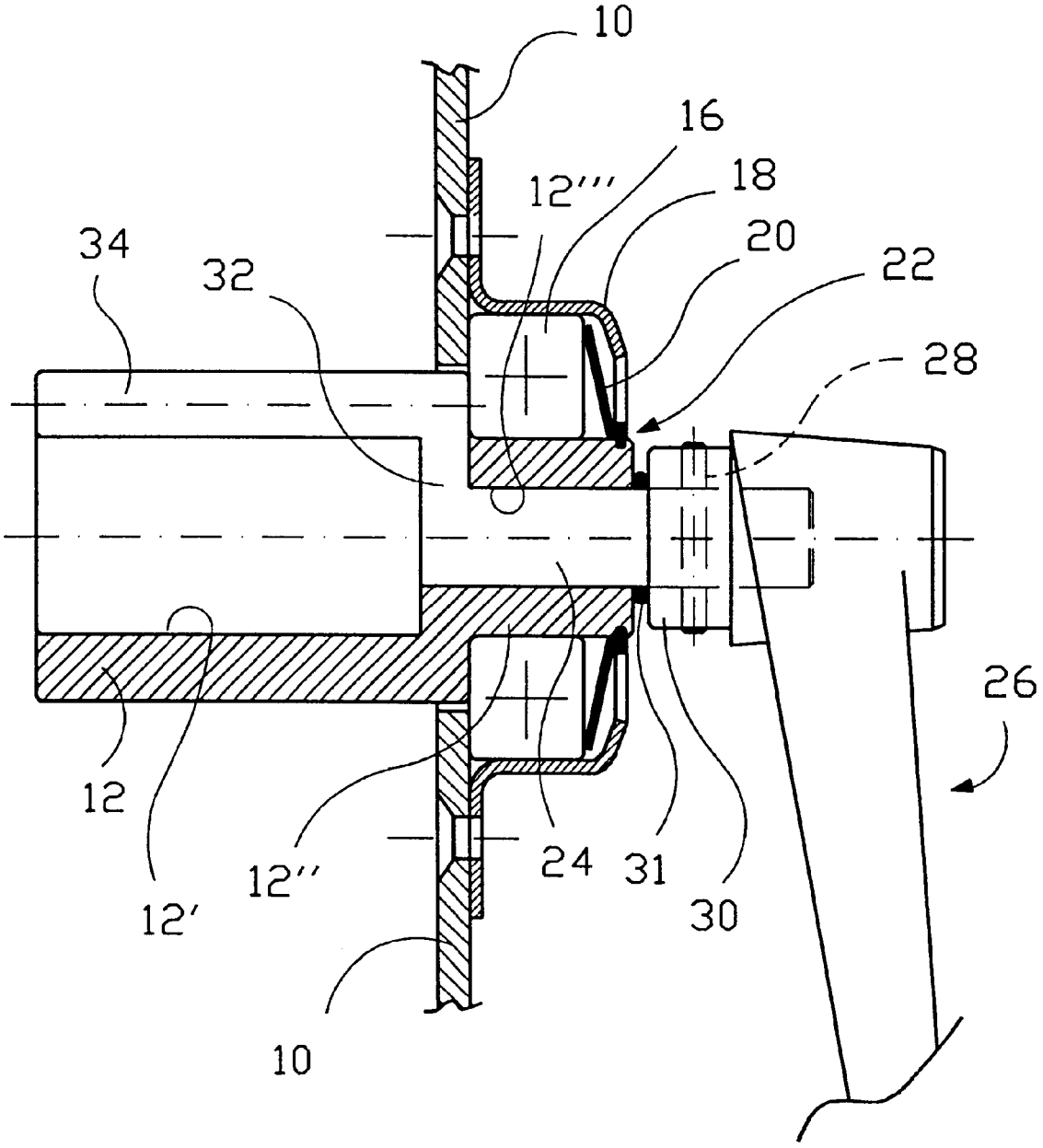
FIG. 7 shows a partial view of the winding device, partly in side view, partly in axial section.

Reference is made to FIG. 7, where the inner cavity of the sleeve-shaped coil 12 is denoted at 12'. The coil 12 has an inner—in relation to its outer, free end—coaxial, tapered, cylindrical mounting portion 12" surrounded by the rotary part of a ball bearing 16, the stationary circumferential part thereof is kept in place by means of a mainly cup-shaped cover 18 also surrounding a central plate spring 20. The plate spring 20 is kept in place and pressed brakingly against the mounting portion 12". A circlip 22 engages into an endless groove in the mounting portion 12" of the coil as well as locks the mounting portion 12" and the coil 12 against the plate spring 20.

The mounting portion 12" of the coil 12 has a coaxial bore 12'"through which extends a crank shaft 24, the crank being denoted at 26. The crank 26 is locked to the crank shaft 24 through a lateral split pin 28 extending through the crank shaft 24 and a surrounding sleeve 30 firmly connected to one end portion of the crank 26, the opposite end of the latter having a lateral handle proper 26'.

Reference numeral 31 denotes an O-ring placed between the end face of the coil's mounting portion 12" and the opposing end face of the sleeve 30.

Figure 5:
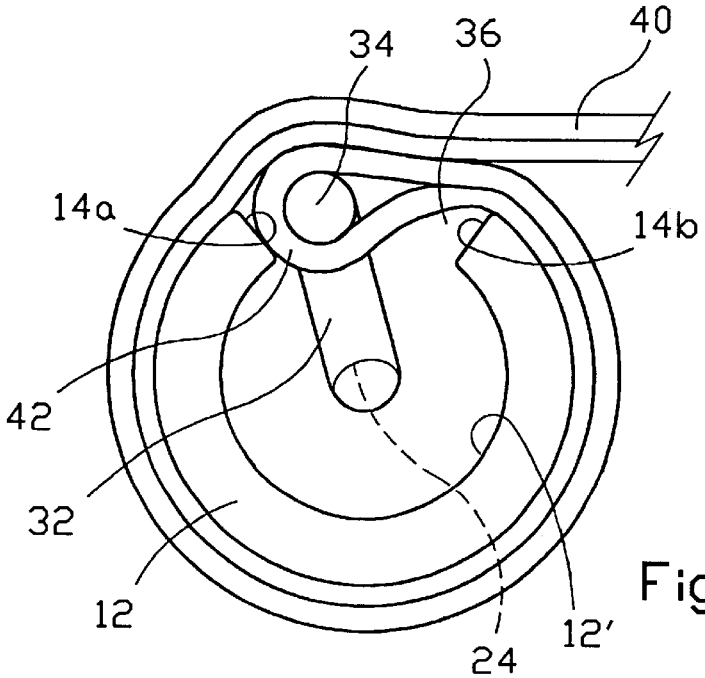
FIG. 5 shows a corresponding front view of a winding device, the sleeve-shaped coil thereof being formed and dimensioned for winding fire hoses laid double or loading straps having a loop-shaped central portion.
Figure 6:
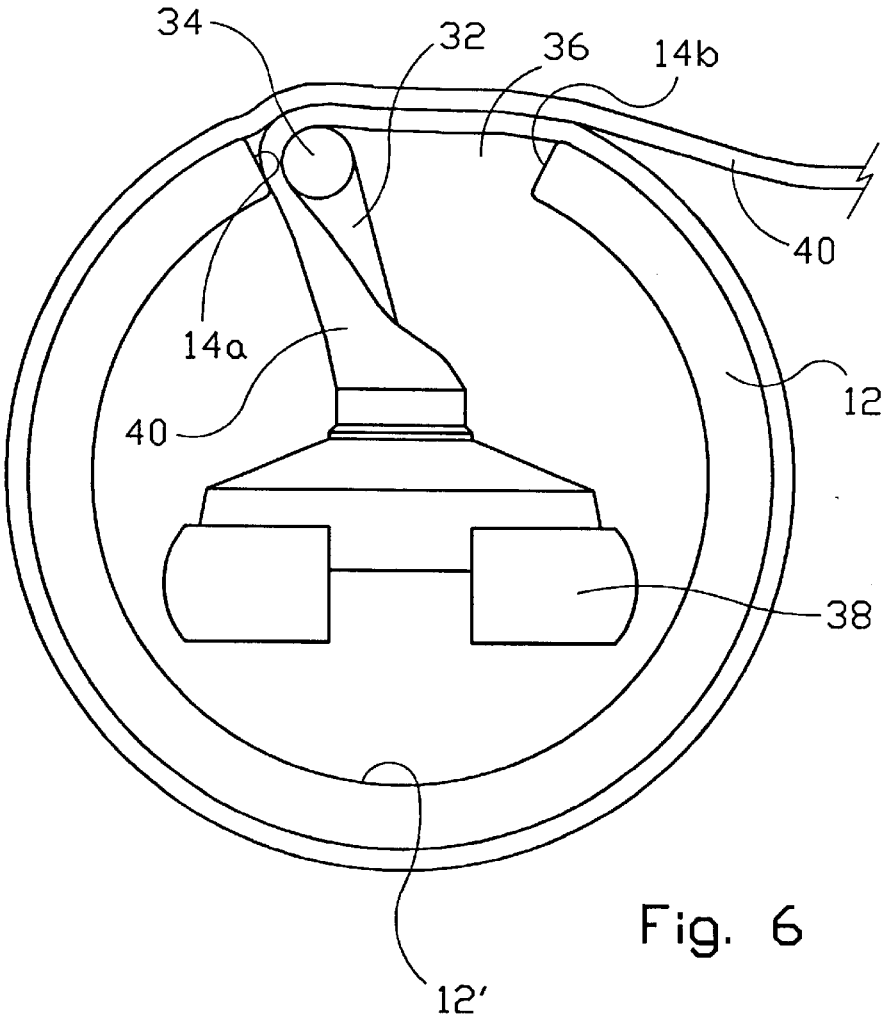
FIG. 6 shows a front view corresponding to FIG. 5 of a winding device where the sleeve-shaped coil has a significantly larger diameter than the coil in FIG. 5, so that it can accommodate e.g. one end connector on a fire hose.

From FIG. 7, it further appears that the outer end of the crank shaft 24, opposite the crank 26, through a lateral crank arm 32 is twisting strengthly connected to a rod-shaped clamp means 34 parallel to the axis of the crank shaft and adapted to cooperate with one of the two clamp faces 14*a*, 14*b* defining the sleeve-shaped coil's cavity 36, FIGS. 5 and 6.

The circumferential clearance within the coil cavity 36 is assigned to the clamp portion pivotable from clamp face to clamp face on the coil upon a change of winding direction.

As the clamp means 34 is rigidly connected to the crank and the clamp action thereof, in respect of one clamp face 14*a* or the other 14*b*, dependent on the rotational direction of the crank, is based on relative movement between the coil 12 and the clamp means 34 in the circumferential direction of the coil 12, the coil 12 is capable of turning freely, except from the braking provided by the plate spring 20. Such clamping action will not be necessary when a loop is threaded unto the clamp means 34 as shown in FIG. 1.

A fire hose 40 is provided with end connectors 38, 38'.

Figure 4:
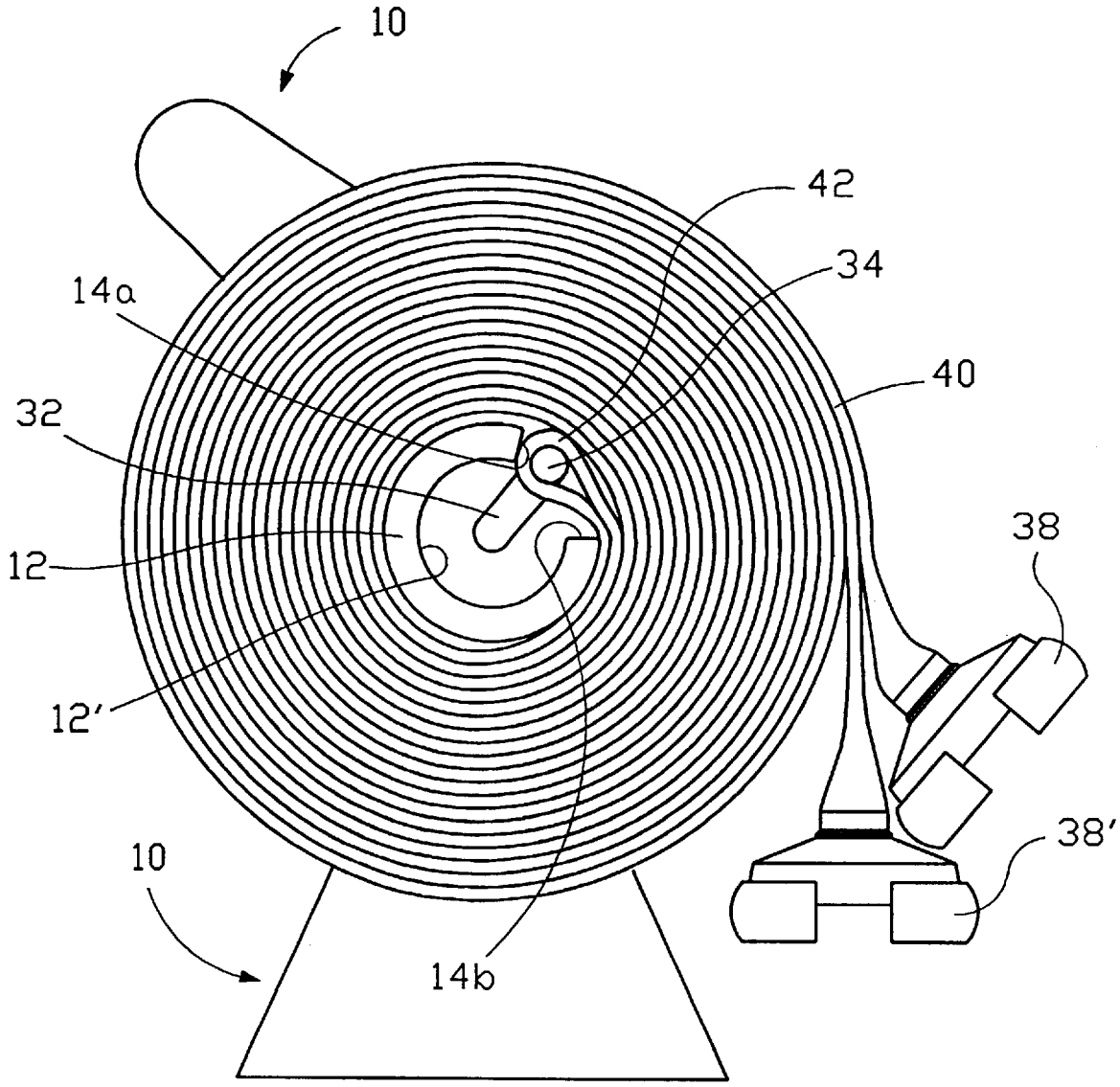
FIG. 4 shows a front view of a wound fire hose, where the winding has started at the centre of its length.

According to FIGS. 1–5, the fire hose's 40 loop 42 is threaded unto the clamp means 34 which, in the form of a freely projecting pin is well suited to receive the loop 42. In FIG. 4, the whole fire hose 40 except the end connectors 38, 38' has been wound up on the coil 12. In this wound-up condition, the circle-disc-shaped wound-up fire hose 40 is withdrawn from the frame 10, in the axial direction in which the coil 12 and the clamp means 34 point with their free ends. It appears from FIG. 6 that the coil 12 is formed with a so large internal cavity 12' that there is space for the accommodation of one 38 of the end connectors of the fire hose 40. This end connector 38 is pushed into the inner cavity 12' of the coil 12 through the axially outer opening 12' of the latter.

When the loop 42 is placed around the clamp means 34 and the crank 26,26' is turned, the clamp means 34 is rotated in the same direction due to its rigid connection with the crank, and brings a hose material layer of the loop 42 into pressing contact with one clamp face 14*a* or 14*b* of the coil 12. As mentioned, the coil 12 is freely rotationally mounted in the bearing 16 and is braked only moderately by means of the plate spring 20, FIG. 7.

When a fire hose 40, a loading strap or a similar, very elongate, narrow, flexible element has been wound up on the coil 12, FIG. 4, the clamp means 34 is turned somewhat back against the rotational direction, in order to nullify the clamping action in respect of the clamp face 14*a* and the intermediate fire hose material, whereupon the fire hose is withdrawn from the device.

What is claimed is:

1. A winding device for fire hose which upon winding is placed such that two hose lengths from a double-laid hose, the center of the single, full length hose forming a loop-shaped end to be attached to a freely rotary coil of the winding device, said winding device further comprising:

a crank having a crank shaft securely attached to a fastening and clamping means restrictedly pivotal about a longitudinal axis of the crank shaft within a radially oriented, outwardly open cavity in the coil of the winding device, defined by two opposing stop and clamping faces, with which said fastening and clamping means cooperates one at a time, dependent on rotational direction of the crank shaft, with a fire hose end portion positioned therebetween in a starting position of the winding device corresponding to an initial hose end fastening position in order to, therereupon, to be clamped between the fastening and clamping means and the adjacent stop and clamping faces upon rotation of said crank shaft, and wherein in said initial starting position said fastening and clamping means, from its secure attachment to the crank shaft, is shaped like a cantilever rod and is accessible 360 degrees around a full length of a circumference thereof, to form a fastener for said loop-shaped end portion to be threaded onto the rod from the free end thereof.

2. A winding device as set forth in claim 1, wherein the cantilever rod-shaped fastening and clamping means are connected to the crank shaft through an intermediary of a lateral crank arm.

3. The winding apparatus as in claim 1, wherein the crank is manually operated.

* * * * *